United States Patent [19]

Huang

[11] Patent Number: 4,763,415

[45] Date of Patent: Aug. 16, 1988

[54] COMBINED SCISSORS AND PENCIL SHARPENER

[76] Inventor: Andrew Y. Huang, 3rd Fl., No. 10-1, Tien-Mou N. Road, Shih-Lin District, Taipei, Taiwan

[21] Appl. No.: 24,816

[22] Filed: Mar. 12, 1987

[30] Foreign Application Priority Data

Dec. 3, 1986 [TW] Taiwan ..... 75211487

[51] Int. Cl.[4] ..... B26B 13/22

[52] U.S. Cl. ..... 30/123; 30/146; 30/254; 30/459; 7/160

[58] Field of Search ..... 30/123, 138, 139, 145, 30/146, 254, 451–462; 7/160

[56] References Cited

U.S. PATENT DOCUMENTS

| | | | |
|---|---|---|---|
| 389,553 | 9/1888 | Diefendorf | 30/254 X |
| 580,995 | 4/1897 | Thorlakson | 30/146 |
| 3,294,067 | 12/1966 | Chipman et al. | 30/459 X |
| 4,435,901 | 3/1984 | Nishikawa | 30/254 |

*Primary Examiner*—Frank T. Yost
*Assistant Examiner*—Michael D. Folkerts
*Attorney, Agent, or Firm*—Kenyon & Kenyon

[57] ABSTRACT

A combined scissor and pencil sharpener includes a pair of scissors having plastic looped handle portions one of which incorporates a pencil sharpener in order to offer the user dual access of both implements.

8 Claims, 2 Drawing Sheets

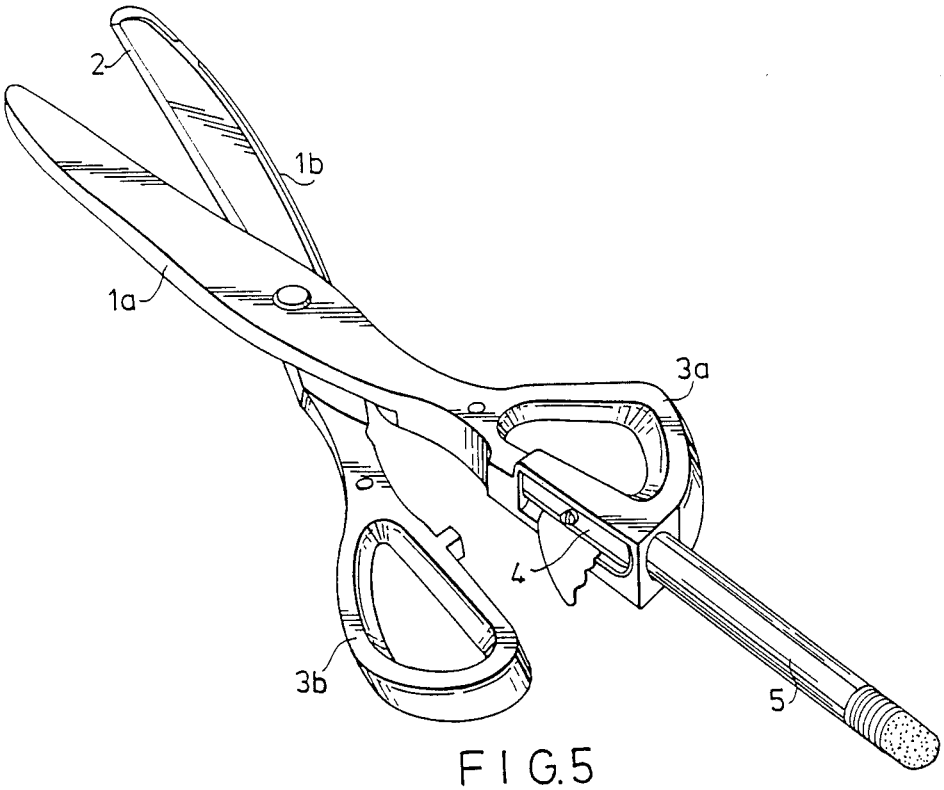
FIG.5
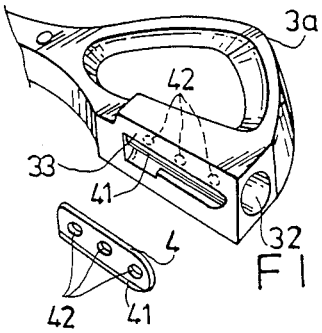
FIG.3
FIG.4

COMBINED SCISSORS AND PENCIL SHARPENER

BACKGROUND OF THE INVENTION

This invention relates to a pair of scissors and particularly to a pair of scissors incorporating a pencil sharpener.

Scissors and pencil sharpeners are essential implements for children during their manual training, for office personnel during routine procedures and for those who engage in finearts, such as cut-out and paste design, drawing, sculpturing etc. Typical scissors are simply constituted of a pair of pivoted elongated planar members each having a looped handle and a cutting edge to shear thin sheets such as paper, cloth etc. Therefore, for shearing and pencil sharpening, both the scissors and sharpener should be in hand for convenient use.

SUMMARY OF THE INVENTION

An object of the invention is to provide a combined scissors and pencil sharpener which offers dual use so that one can effect both cutting and sharpening with a single implement.

The present invention provides a combined scissor and sharpener which comprises a first elongated planar member having a first elongated cutting blade at the forward portion of the first planar member and a first looped handle at the rear portion of the first planar member, a second elongated planar member having a second elongated cutting blade at the forward portion of the second planar member and a second looped handle at the rear portion of the second elongated planar member, and the improvement wherein one of the first and second looped handles has a thick portion provided with a conical-shaped bore opening at the rearmost side of the looped handle for receiving one end of a pencil. Adjacent to the bore is a blade mounting face with an elongated aperture communicated with the bore. A cutting blade is mounted on the blade mounting face of the thick portion. The scissor so arranged can be used for sharpening a pencil.

The present exemplary preferred embodiment will be described in detail with reference to the accompanying drawings, in which:

BRIEF DESCRIPTION OF THE DRAWINGS

FIG. 3 is a fragmentary view of a combined scissors and pencil sharpener of another embodiment;

FIG. 4 shows a cutting blade to be attached to the sharpener portion of the combined scissors and sharpener of FIG. 3; and FIG. 5 is a view of the combined scissors and pencil sharpener in its used position.

DETAILED DESCRIPTION OF THE PREFERRED EMBODIMENT

Figure 1:
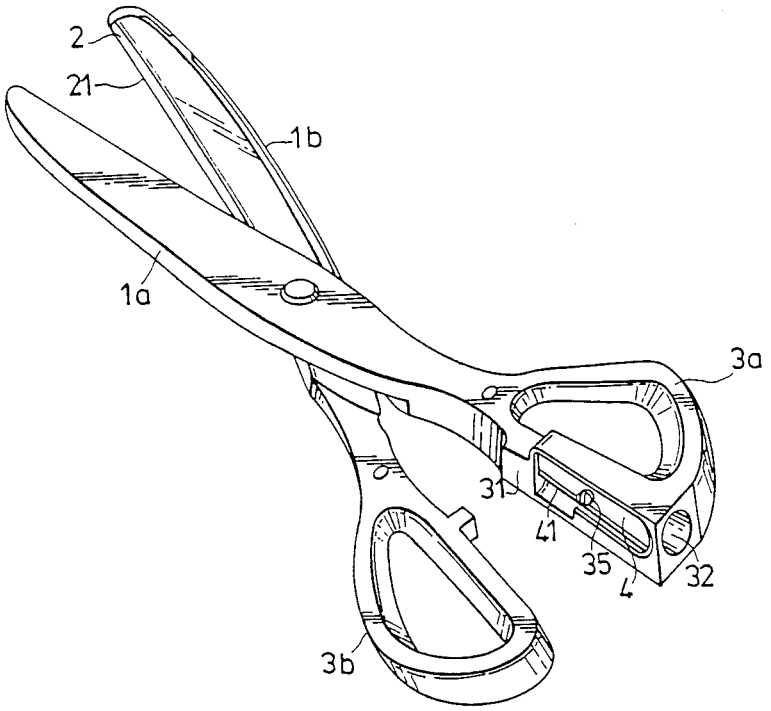
FIG. 1 is a perspective view of a combined scissors and pencil sharpener.
Figure 2:
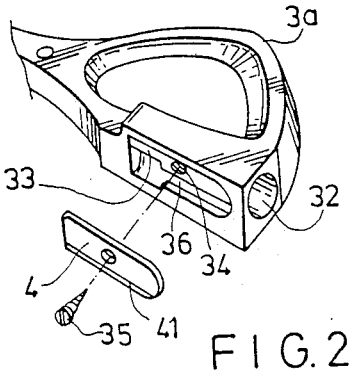
FIG. 2 is a fragmentary exploded view of the combined scissors and pencil sharpener of FIG. 1.

Referring to the drawings, there is shown a combined scissors and pencil sharpener which is fabricated from a plastic material. This device has two elongated planar members 1*a* and 1*b* each incorporating a cutting blade 2 with a cutting edge 21. Two looped handles 3*a* and 3*b* are formed at the rear portions of the planar members 1*a* and 1*b*. The looped handle 3*a* has a thick portion provided with a conical bore 32 opening at the rearmost side of the looped handle 3*a*. Adjacent to the bore 3*a* is a shaving blade mounting face 33 with an elongated aperture 36 communicated with the bore. A shaving blade 4 is attached to the blade mounting face 33 by means of a screw 35 which is threaded through the blade 4 and a screw hole 34.

Referring to FIGS. 3 and 4, in an alternative preferred embodiment of the invention, the cutting blade 4 for pencil-sharpening is provided with holes 42 and is attached to the blade mounting face 33 of the looped handle 3*a* by being placed in a mold during forming the elongated planar member 1*a*. Thus, the cutting blade 4 is encapsulated partially in the molded loop handle 3*a* and firmly secured to the molded looped handle 3*a* by means of the engagement of the holes 42 and the molded part.

With the invention thus explained, it is apparent that various modifications and variations can be made without departing from the scope of the invention. It is therefore intended that the invention be limited as indicated in the appended claims.

What I claim is:

1. A combined scissors and sharpener comprising:

a first elongated planar member having a first elongated cutting blade at the forward portion of said first planar member and a first looped handle at the rear portion of said first planar member;

a second elongated planar member having a second elongated cutting blade at the forward portion of said second planar member and a second looped handle at the rear portion of said second elongated planar member;

one of said first and second looped handles having a thick portion with a conical bore opening at the rear side of said looped handle for receiving one end of a pencil, and a blade mounting face adjacent to the bore and integral with an edge of said one looped handle, the mounting face having an elongated aperture communicated with the bore, and a shaving blade mounted on the blade mounting face.

2. A combned scissors and pencil sharpener as claimed in claim 1, wherein said first and said second elongated planar members are molded plastic members.

3. A combined scissors and pencil sharpener as claimed in claim 1 wherein said bore and said blade mounting face are disposed in that potion of said one looped handle that is adjacent to the other looped handle.

4. A combined scissors and pencil sharpener as claimed in claim 2 wherein said shaving blade is partially encapsulated in said molded looped handle.

5. A combined scissors and pencil sharpener comprising:

a first elongated planar member having a forward portion and a rear portion, with a first elongated cutting blade at the forward portion of said first planar member and a first looped handle at the rear portion of said first planar member;

a second elongated planar member having a forward and rear portion, with a second elongated cutting blade at the forward portion of said second planar member and a second looped handle at the rear portion of said second elongated planar member, each of the first and second looped handles having a substantially straight inner portion;

means for pivotally connecting the first and second planar members in superposed crossed condition at a location intermediate the blade and the handle of each planar member such that the inner portions of the first and second looped handles face each other and the first and second cutting blades are in superposed contact with each other when the scissors are closed, wherein the improvement comprises:

one of the inner portions of said first and second looped handles having a thick portion, said thick portion having a conical bore opening to the rear of said looped handle for receiving one end of a pencil to be sharpened, the bore having an elongated aperture opening onto a surface of the inner portion that faces the inner portion of the other looped handle and a shaving blade mounted with a cutting edge of the shaving blade disposed adjacent said aperture such that shavings created by rotation of a pencil in the bore adjacent the cutting edge are ejected through said aperture.

6. A combined scissors and pencil sharpener as claimed in claim 5, wherein said first and said elongated planar members are molded plastic members.

7. A combined scissors and pencil sharpener as claimed in claim 6 wherein said shaving blade is partially encapsulated in said molded looped handle.

8. A combined scissors and pencil sharpener as claimed in claim 5 wherein the surface of the inner portion of the one looped handle that faces the inner portion of the other looped handle includes a blade mounting face, and the combined scissors and pencil sharpener further comprises a means for releasably mounting the blade on the blade mounting face.

* * * * *